United States Patent [19]

Le Tarte

[11] 4,347,639

[45] Sep. 7, 1982

[54] DEBURRING APPARATUS

[75] Inventor: Walter Le Tarte, Smiths Creek, Mich.

[73] Assignee: Richard A. Anthony, Oak Park, Mich. ; a part interest

[21] Appl. No.: 253,604

[22] Filed: Apr. 13, 1981

[51] Int. Cl.[3] ..... A46B 13/02

[52] U.S. Cl. ..... 15/21 D; 15/268; 51/98 R; 51/238 R

[58] Field of Search ..... 15/21 R, 21 D, 21 E, 15/268; 51/125, 219 R, 238 R, 238 S, 238 GG, 98 R, 219 PC

[56] References Cited

U.S. PATENT DOCUMENTS

| | | | |
|---|---|---|---|
| 2,371,676 | 3/1945 | Coyne | 51/219 R |
| 2,874,520 | 2/1959 | Hoerst | 51/219 PC |
| 3,852,921 | 12/1974 | Craig et al. | 51/219 R |
| 4,216,560 | 8/1980 | Schmidt | 15/21 D |

*Primary Examiner*—Edward L. Roberts

*Attorney, Agent, or Firm*—Cullen, Sloman, Cantor, Grauer, Scott & Rutherford

[57] ABSTRACT

In a deburring apparatus having a housing with front and rear walls, a base and a power rotated deburring wheel within the housing and partly projecting through the front wall, a workpiece holder assembly is arranged forwardly of the front wall in registry with the deburring wheel. The workpiece holder assembly has an elongated feed tube guidably mounted upon the base. A feed screw assembly interconnects the base with the feed tube and is actuated from the rear of the housing. Vertical feed tube is coplanar with and at substantial right angles to the elongated feed tube and upon one end is secured thereto. A workpiece holder shaft is telescoped within the vertical feed tube and mounts a transverse workpiece support. A feed screw assembly interconnects the vertical feed tube and workpiece holder shaft and is adapted on actuation to raise and lower the workpiece holder shaft and connected workpiece support.

17 Claims, 7 Drawing Figures

DEBURRING APPARATUS

BACKGROUND OF THE INVENTION

Illustrative of deburring apparatus of the present type is the U.S. Pat. No. 4,216,560. The disadvantage of that construction is that there is no positive control for horizontal in and out feeding of the workpiece holder assembly relative to the deburring wheel, nor is there a positive control for vertical adjustments of the workpiece holder with respect to the deburring tool.

SUMMARY OF THE INVENTION

An important feature of the present invention is the provision of a deburring apparatus which has a housing with front and rear walls, a base and a deburring wheel rotatably mounted within the housing on the base upon a longitudinal axis and with the wheel partly projecting through the front wall. Associated with said deburring apparatus is a workpiece holder assembly which is arranged forwardly of the front wall for holding a workpiece in registry with the wheel. The workpiece holder assembly includes a mechanism for controlled in and out feeding horizontally of the workpiece holder assembly with respect to the deburring wheel and controlled vertical adjustment of the support upon the workpiece holder assembly for regulating vertical adjustments of the workpiece support with respect to said wheel.

An important feature of the present invention is directed to a workpiece holder assembly for use in conjunction with a deburring apparatus having a power rotated deburring wheel which partly projects through the front wall of the housing. A workpiece holder assembly is arranged forwardly of the front wall and a portion thereof projects across the base for in and out adjustments under the control of a screw mechanism. Connected with the workpiece holder assembly as a part thereof is a vertical feed tube which is inclined upwardly toward the front face of the housing and mounts a workpiece holder shaft telescoped therein which incorporates a screw mechanism between the vertical feed tube and the workpiece holder shaft for controlled vertical adjustment of the transverse workpiece support upon said shaft.

A further feature provides for controlled in and out movements of the workpiece holder assembly with respect to the deburring wheel and controlled vertical adjustments of the workpiece holder with respect to the deburring wheel whereby the parts of the workpiece holder assembly are not responsive merely to a sliding action, but on the other hand are under positive control for horizontal and vertical adjustments.

A further feature includes a power drive for the deburring wheel, namely an electric motor with a drive shaft and with a driven shaft journalled upon the base within the housing parallel to the drive shaft and connected therewith by a pair of pulleys. These are of different sizes and connected together by a continuous belt to establish a first speed of rotation of the deburring wheel. The pulleys are interchangeable with respect to said shafts selectively providing a modified speed for the deburring wheel.

A further feature incorporates a deburring wheel guard housing which partly encloses the forward portion of the deburring wheel and which is connected to the workpiece holder assembly and adapted for in and out movements relative to the front wall of the housing, simultaneous with in and out adjustments of the workpiece holder assembly and with respect to the deburring wheel.

These and other features will be seen from the following specification and claims in conjunction with the appended drawings:

THE DRAWINGS

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
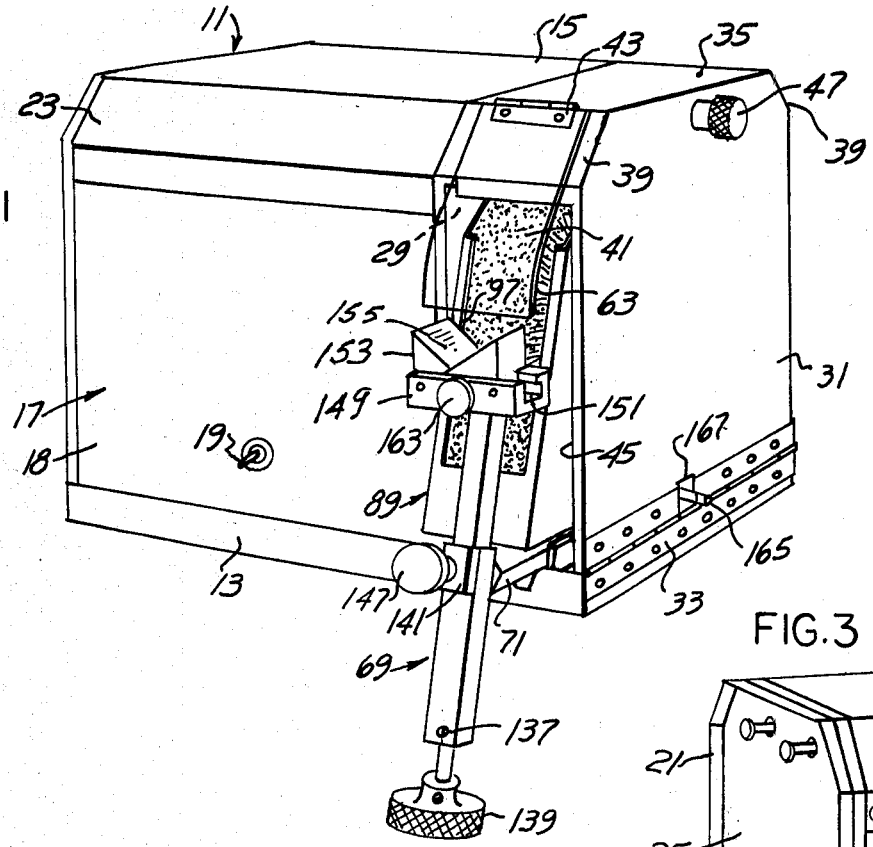
FIG. 1 is a front perspective view of the present deburring apparatus.
Figure 2:
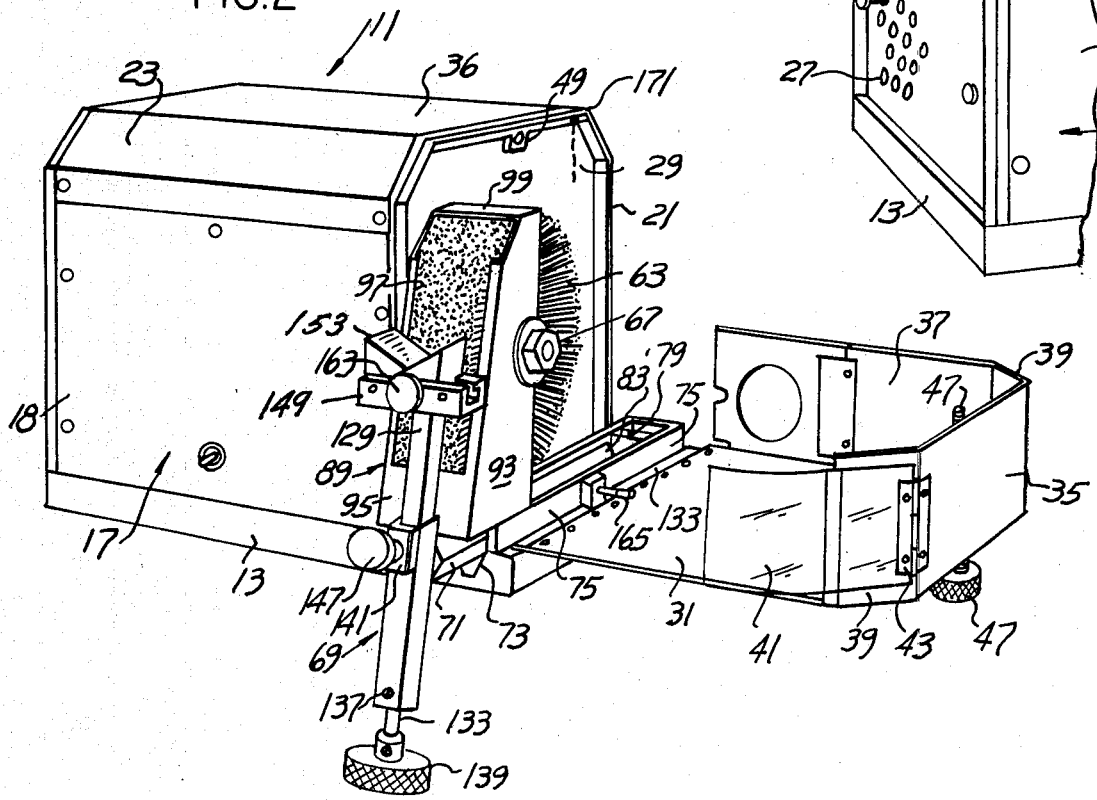
FIG. 2 is a similar view with a portion of the deburring wheel housing hinged to an open position.
Figure 4:
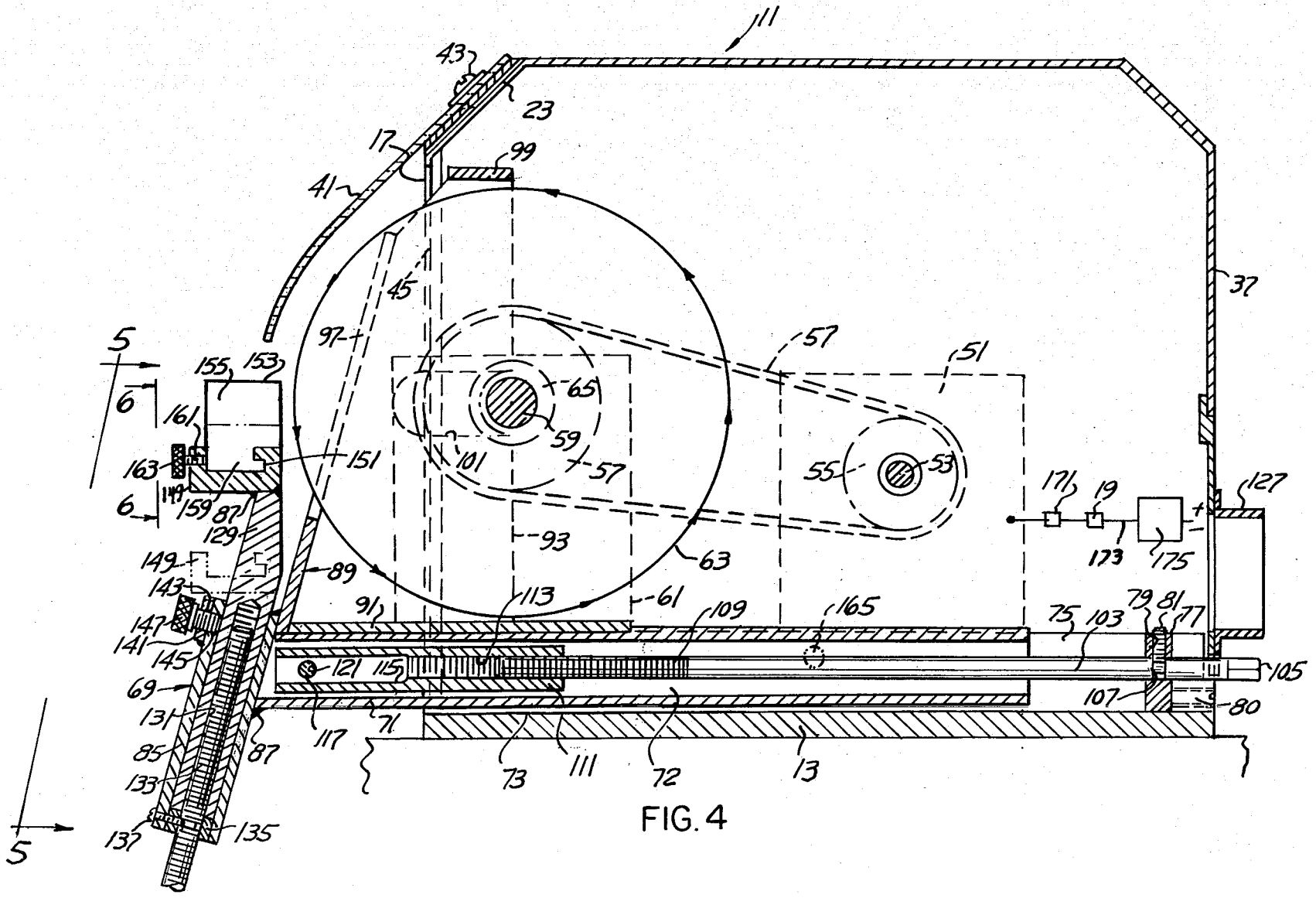
FIG. 4 is a fragmentary vertical section on an enlarged scale of the deburring apparatus of FIG. 1.
Figure 5:
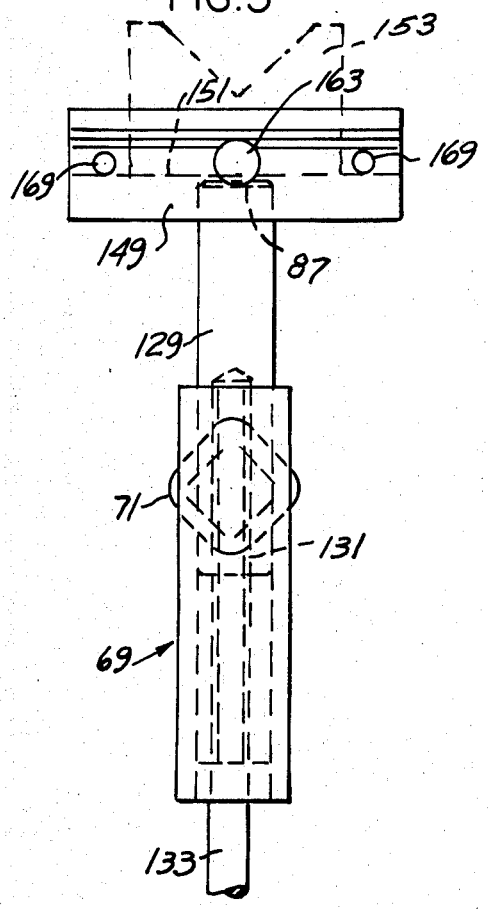
FIG. 5 is a fragmentary end view taken in the direction of arrows 5—5, FIG. 4.

Referring to the drawings, the present deburring apparatus is generally indicated at 11 in FIG. 1 and as shown in FIGS. 1, 2 and 4 has a base 13 and an overlying housing 15 which includes the front wall 17 with removable panel 18 upon which is a conventional motor control switch 19.

Figure 3:
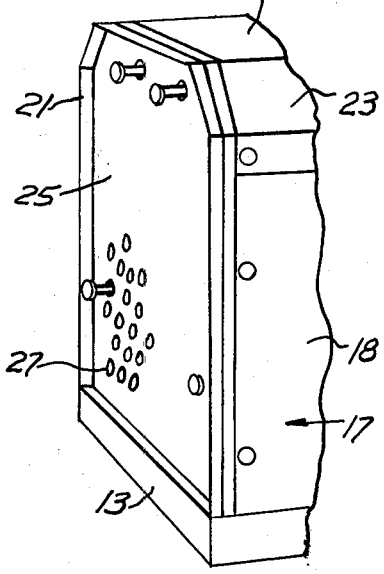
FIG. 3 is a fragmentary perspective view of the end of the housing, not shown in FIG. 1.

The housing includes back wall 21 and the angular front wall 23, FIG. 2 and one end panel 25, FIG. 3 which is removable for access to the motor drive assembly upon the interior of said housing.

The opposite end of the housing has an upright end panel 31, which along its lower edge is hinged to the base as at 33 and includes a right angularly related top wall portion 35, backwall portion 37 and the angular walls 39 normally adapted for cooperative registry with the corresponding walls of the housing when the end panel 31 has been tilted to the use position shown in FIG. 1.

Rectangular transparent shield 41, constructed of a plastic material overlies the angular front portion 39 of the housing and is secured thereto as by fasteners 43. The lower edge of the shield is spaced above the adjustable workpiece holder 153 as shown in FIG. 1.

The front wall of the housing has an upright rectangular aperture 45 at one end thereof below the corresponding tapered wall portion 39 through which portions of the deburring wheel guard 89 mounted upon the workpiece holder assembly, adjustably projects.

When the end panel 31 is in the upright position completing the housing enclosure, it is secured in such position by the hand fastener 47 which threadedly engages nut 49 on the housing as shown in FIG. 2.

Said housing includes a top wall 36. Interposed between the front and rear walls, base 13 and said wall 36 is an upright partition 29 arranged intermediate the ends of the housing upon one side of the deburring wire wheel 63. An electric motor 51 shown schematically in FIG. 4 is mounted and secured upon the base 13 within said housing and includes a drive shaft 53 mounting a pulley 55. V belt 57 interconnects pulley 55 with a second pulley 57 of a different diameter which is mounted upon the driven shaft 59 mounted upon the journal blocks 61 secured upon the base 13 within said housing.

Wheel shaft 59 projects through an aperture in partition 29 and mounts on its end the power rotated wire deburring wheel 63, FIGS. 2 and 4. Said wheel is arranged outwardly of partition 29 and enclosed by the end wall 31 and connected top and side wall portions, 35, 37 and 39, when in the use position shown in FIG. 1.

Said deburring wheel, of a conventional construction, consists of a series of wire segments which radially extend outward from a central hub 65, FIG. 4, which is mounted upon the driven shaft 59 and secured thereto by fastener 67, FIG. 2.

A workpiece holder assembly is generally indicated at 69, FIGS. 1 and 2 and is shown in detail in FIG. 4. The workpiece holder assembly includes an elongated tube 71, which is square in crossection and has a bore 72. Said tube is guidably mounted with respect to the rearwardly extending V-shaped groove or channel 73 formed within the base 13 and adjacent one end thereof and extending from the front wall 17 to the rear wall portion 37.

As shown in FIGS. 2 and 4, a pair of substantially upright parallel spaced side supports 75 are secured upon base 13 on opposite sides of the groove 73, said supports being transversely slotted at 77. Supports 75 may be cast as a part of aluminum base 13.

Upright block 79 is nested within slots 77 and is secured therein be the fastener 80, FIG. 4. Set screw 81 is threaded down into block 79 with its inner end adapted for positioning within an annular groove 107 formed within the elongated feed screw 103, FIG. 4.

A pair of downwardly converging rails 83 forming a V-shaped trough are secured to the respective side supports 75 interiorly thereof and extend down into the base groove 73. These rails provide a guide support for the elongated feed tube 71.

Vertical feed tube 85, of square crossection is coplanar with the elongated feed tube 71 and at its upper end is secured thereto as by the welds 87, FIG. 4. Said vertical feed tube is substantially at right angles to tube 71, but is inclined upwardly towards the front wall 17. The approximate angle relationship between the vertical feed tube 85 and the in and out feed tube 71 is approximately 105 degrees.

The deburring guard wheel housing 89, FIG. 2, is mounted upon the in and out longitudinal feed tube 71 and is secured thereto. Said guard housing includes base plate 91. The elongated tube 71 is arranged so that a pair of its diametrically opposed vertical apices are vertical for guided support and mounting upon the rails 83.

Housing base plate 91 extends across the top edge of tube 71 and is secured thereto as by welds, with portions of the base plate projecting laterally from opposite sides of said tube. The housing includes a pair of upright spaced side walls 93 with their lower ends secured to the base plate 91 and interconnected at their upper ends by the top wall 99. Said housing includes upwardly and rearwardly inclined front wall 95 parallel to the axis of the vertical feed tube 85 and having an aperture 97 in its inclined front face to provide access to the deburring wheel 63.

Opposed slots 101 are formed through the respective side walls 93 and are adapted to loosely receive the driven shaft 59 for the deburring wheel 63. Said wheel is partly nested within the guard housing 89, as best shown in FIG. 2. By this construction, the entire workpiece holder assembly and particularly the wheel guard housing is adapted for in and out adjustments relative to the housing 15 and relative to the deburring wheel 63 which is rotatable upon a horizontal fixed axis.

Referring to FIG. 4, an elongated feed screw 103 is axially nested within the bore 72 of the elongated tube 71 and at one end guidably extends through block 79 and projects outwardly of the housing wall 37 and terminates in a polygonal end 105, such as square, for application of a wrench thereto.

Figure 7:
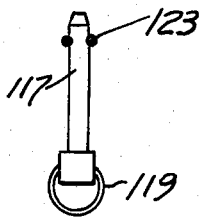
FIG. 7 is a fragmentary plan view of the detent pin which pivotally connects the elongated tube and the feed tube for the workpiece holder assembly.

Rotatable feed screw 103 is retained against longitudinal movement relative to the base by the set screw 81, FIG. 4 whose inner end registers within the annular groove 107 in said feed screw. The feed screw includes a threaded portion 109 at its other end threaded into the threaded bore 113 of the feed tube 111 which is loosely nested within the bore 72 of tube 71. Feed tube 111 has a counterbore 115 at one end. One end of said feed tube is pivotally connected to the corresponding end of the longitudinal tube 71 by the transverse detent pin 117, also shown in FIG. 7, which has a ring 119 at one end thereof to facilitate manipulation. Said detent pin extends through corresponding apertures in the adjacent end of the elongated tube 71 and through the cross bores 121 within the end of the feed tube 111. Said detent pin includes a snap anchor ring 123 on one end adapted to retain the pin when assembled with respect to elongated tube 71.

In operation rotative adjustment of the feed screw 103 effects longitudinal adjustments of the feed tube 111 and simultaneous longitudinal adjustment of the elongated tube 71 connected thereto.

As shown in FIG. 4, the compartment within which the deburring wheel 63 rotates and outwardly of the partition 29 includes an exhaust connection 127 by which metal particles accumulated during the deburring operation can be withdrawn by a suitable suction applied thereto and for avoiding dispersion of such particles to atmosphere.

Telescoped within the upper end of the vertical feed tube 85 is the workpiece holder shaft 129 which projects thereabove and includes an axial threaded bore 131 which receives one end of the vertical adjusting screw 133. Said screw extends through the apertured guide block 135 within the lower end of the vertical feed tube 85 and terminates in the rotatable hand grip 139, FIG. 2.

The vertical adjusting screw 133 is retained against longitudinal movement by the transverse set screw 137 which is threaded through the lower end portion of the vertical feed tube 85 and extends through the apertured guide block 135 and is nested within an annular groove within the vertical adjustment screw 133. This is the same as shown at 79 and 107 of FIG. 4.

While not required for the land screw operated vertical adjustment of the piece holder shaft 129, there is employed a locking device for securing the workpiece holder shaft 129 in any preselected adjusted position. This includes the nut 141 mounted upon the outer face of the vertical feed tube 85 at its upper end and secured thereto as by welding. Said nut has a threaded bore 143 which receives the lock screw 145 having a knurled handle 147. The inner end of the lock screw 145 is adapted for operative frictional retaining engagement with the workpiece holder shaft 129.

Figure 6:
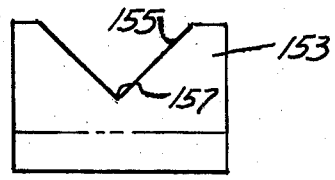
FIG. 6 is a fragmentary end view taken in the direction of the arrows 6—6 of FIG. 4.

As shown in FIGS. 1, 2, 4 and 5 transversely extending workpiece support 149 is horizontally disposed and mounted across the upper end of the piece holder shaft 129 and suitably secured thereto as by the weld 87. Said support has formed within its upper portion, an elongated undercut guide slot 151 along its length. Adjustably mounted and supported within said guide slot is the upright workpiece holder 153 transversely adjustable within support 149. The workpiece holder 153 is shown in FIG. 6 having a V-shaped notch 155. Its apex at 157 is in substantial registry with the central portion of the deburring wheel 63 and its axis of rotation corresponding to the shaft 59 in FIG. 4.

The notched portion 155 of the workpiece holder is adapted to receive an end portion of the object to be deburred such as a rod or a tube which is projected through guard housing aperture 97 into operative registry with the power rotated deburring wheel. An elongated flanged guide key 159 depends from the undersurface of the workpiece holder 153 and is interlockingly nested within the undercut slot 151 within the workpiece holder 149 as best shown in FIG. 4.

The workpiece holder 153, thought transversely adjustable upon its support 149 may be secured in adjusted position by the lock screw 161 having a handle 163. Said lock screw is threaded into workpiece support 149 for frictional operative engagement with the workpiece holder 153. Additional threaded bores 169 are formed through the workpiece support 149 for either receiving further lock screws or for selectively receiving lock screw 161 depending upon the longitudinal transverse adjustment of the workpiece support block 153.

Referring again to FIGS. 1, 2 and 4, clamp screw 165 is threaded into the outer of one side support 75 and projects through a corresponding recess 167 within the hinged end panel 31, whereby once the longitudinal feed tube 71 has been adjusted, it may be frictionally anchored in such adjusted position by the clamp screw 165. Said screw is adapted for operative securing engagement with the elongated feed tube 71.

A safety limit switch 171, FIG. 2 is mounted upon some portion of a housing such as adjacent partition 29 and is connected into the electrical circuit 173, schematically shown in FIG. 4, to a suitable electrical power source 175. The off and on switch 19 on the front panel 18, FIG. 1 is connected into said circuit all as schematically shown in FIG. 4. This safety feature assures that when the hinged end wall 31 is in the open position shown in FIG. 2, the power is disconnected from the electric motor disconnecting the drive from the deburring wheel 63. Thus, the deburring wheel 63 will rotate only when hinged wall 31 has been tilted to the closed position shown in FIG. 1 so as to protectively enclose the deburring wheel 63.

OPERATION

The initial rotation of the longitudinal feed screw 103 by wrench as at 105, FIG. 4 presets the workpiece holder assembly 69 in an in and out direction horizontally with respect to the front wall 17 of the housing.

Rotation of the hand wheel 139 at the lower end of the vertical feed tube 85 will cause raising or lowering of the workpiece holder shaft 129 so that the workpiece holder 153 is properly positioned for application of a workpiece to be deburred to the deburring wheel 63. The in and out feed movements of the workpiece holder assembly is under the control of the feed screw 103 and the vertical adjustment of the piece support 144 is under the control of the manually rotatable feed screw 133.

As desired, the holder block 153 upon the workpiece support may be transversely adjusted as desired and further secured in such adjusted position by the lock screw 163.

The workpiece stock, tube or rod or other object to be deburred is normally held in a substantially horizontal position with the end portion to be deburred, nested within the apex 155 of the support block 153 and is moved sufficiently forward as to provide operative engagement with the deburring wheel for the deburring operation.

For having described my invention, reference should now be had to the following claims.

I claim:

1. In a deburring apparatus having a housing with front and rear walls, a base and a deburring wheel rotatably mounted within said housing on said base upon a longitudinal axis, with the wheel partly projecting through said front wall;

a workpiece holder assembly forwardly of said front wall for holding a workpiece in registry with said wheel;

a guide on said base extending rearwardly of said front wall;

an elongated tube overlying said base movably mounted upon said guide;

an elongated screw nested within and projecting from one end of said tube, at one end journalled upon said base, retained against longitudinal movement and projecting through and outwardly of said rear wall;

a feed tube having a threaded bore nested within the other end of said elongated tube, at one end threadably receiving said screw and at its other end pivotally connected to the other end of said elongated tube;

whereby selective manual rotation of said screw adjustably feeds said elongated tube and connected workpiece holder assembly inwardly and outwardly of said housing relative to said deburring wheel.

2. In the deburring apparatus of claim 1, said guide being V-shaped;

said elongated tube being of square crossection with a pair of diametrical apices being vertical.

3. In the deburring apparatus of claim 2, said guide including a V-shaped elongated slot in said base;

a pair of spaced upright side supports on and extending transversely of said base upon opposite sides of the V-shaped slot;

and a pair of inwardly and downwardly inclined rails upon the interior of said side supports extending into said slot defining a V-shaped guide;

said elongated tube being slidably mounted upon said rails.

4. In the deburring apparatus of claim 3, and a screw means adjustably threaded transversely through one of said side supports and extending outwardly of said housing, adapted to frictionally and operatively engage said elongated tube against accidental adjustment.

5. In the deburring apparatus of claim 1, the end of said screw outwardly of said rear wall being polygonal to facilitate turning by the application of a wrench thereto.

6. In the deburring apparatus of claim 1, the drive for said deburring wheel including a motor mounted upon said base having a drive shaft;

a driven shaft spaced from and parallel to said drive shaft and connected to said deburring wheel;

and pulleys of different sizes respectively mounted upon said shafts interconnected by a continuous belt, for a predetermined first speed of rotation of said deburring wheel;

said pulleys being interchangeable upon said shafts for providing a different speed of rotation of said deburring wheel.

7. In the deburring apparatus of claim 1, the retaining of said screw against longitudinal movement including an apertured block transverse to and receiving said screw and mounted upon said base;

said screw having an annular recess therein located within said block;

and a set screw on said block extending into said recess.

8. In the deburring apparatus of claim 1, the pivotal connection between said feed tube and said elongated tube including a detent pin mounted on and extending transversely through said elongated tube and through said feed tube, whereby selective longitudinal adjustment of said feed tube effects a corresponding simultaneous adjustment of said elongated tube.

9. In the deburring apparatus of claim 1, the other end of said elongated tube extending outwardly of said front wall;

said workpiece holder assembly including a vertical feed tube coplanar with and adjacent its upper end secured to said elongated tube and upwardly inclined towards said front wall;

a workpiece holder shaft telescoped within the upper end of said feed tube and similarly inclined;

a transversely extending workpiece support upon the upper end of said holder shaft;

and manually operable screw means upon and interconnecting said vertical feed tube and workpiece holder shaft within and axially thereof, for selectively adjusting said workpiece support vertically with respect to said deburring wheel.

10. In the deburring apparatus of claim 9, said screw means including a feed screw extending axially of said vertical feed tube, retained against longitudinal movement therein and threaded axially into said workpiece holder shaft, whereby manual rotation of said feed screw effects selective feed movements of said workpiece holder shaft relative to said vertical feed tube.

11. In the deburring apparatus of claim 10, the retaining of said feed screw against longitudinal movement including an apertured block secured within one end of said vertical feed tube;

and a transverse set screw extending through said vertical feed tube, through said block and into an annular recess within said feed screw;

said screw means retaining said workpiece holder in a selected position of vertical adjustment.

12. In the deburring apparatus of claim 9, a manually rotatable set screw mounted on and threaded through an upper portion of said vertical feed tube adapted for frictional securing engagement with said workpiece holder shaft for anchoring said holder shaft against accidental adjustment thereof relative to said vertical feed tube.

13. In the deburring apparatus of claim 9, said vertical feed tube and workpiece holder shaft being square in cross section.

14. In the deburring apparatus of claim 1, a deburring wheel guard housing partly enclosing said deburring wheel, comprising a base plate centrally overlying said elongated tube and extending outwardly thereof from opposite sides and secured thereto;

a pair of laterally spaced side walls mounted upon and secured to said base plate and interconnected at their upper ends;

and an upwardly inclined front wall parallel to said workpiece holder shaft having an elongated slot therein providing access to said deburring wheel;

said guard housing being movable relative to said front wall on longitudinal adjustments of said elongated tube.

15. In the deburring apparatus of claim 14, said deburring wheel including a driven shaft extending through said guard housing side walls;

said walls being oppositely slotted to permit inward adjustment of said guard housing relative to said driven shaft.

16. In the deburring apparatus of claim 1, said housing having a top wall;

an apertured partition upon the interior of said housing extending between said front and rear walls and between said base and top walls inwardly of said deburring wheel;

said housing including an end wall hingedly connected along its lower edge to said base and including top and rear wall portions adapted to register with the housing top and rear walls, providing an openable enclosure for said deburring wheel;

and screw means on said end wall for securing said end wall to said housing.

17. In the deburring apparatus of claim 16, an electric motor adapted for connection to a power source;

and a manually open limit switch on said housing connected to said motor, said hinged end wall having a portion engagable with said limit switch when said end wall is rotated to a deburring wheel enclosing position.

* * * * *